United States Patent [19]

Lahr

[11] Patent Number: 4,657,418

[45] Date of Patent: Apr. 14, 1987

[54] HIGH CAPACITY RIBBON SUPPLY ARRANGEMENT

[75] Inventor: Roy J. Lahr, Los Angeles, Calif.

[73] Assignee: Creative Associates, Los Angeles, Calif.

[21] Appl. No.: 797,748

[22] Filed: Nov. 12, 1985

Related U.S. Application Data

[63] Continuation of Ser. No. 570,746, Jan. 16, 1984, abandoned.

[51] Int. Cl.[4] ..... B41J 33/04; B41J 32/00; B41J 33/26; B41J 33/52

[52] U.S. Cl. ..... 400/229; 400/208; 400/212; 400/213; 400/216; 400/223; 400/225; 400/234; 400/235.1; 400/236.1; 400/248

[58] Field of Search ..... 400/185, 187, 196, 196.1, 400/208, 208.1, 211, 212, 213, 213.1, 215, 216, 216.1, 217, 217.1, 223, 225, 228, 229, 231, 232, 234, 235, 235.1, 236, 236.1, 236.2, 248, 249, 322; 74/626, 665 A, 675, 679, 686; 192/54, 55, 56 R; 242/75.4, 75.43, 75.5; 226/181, 182, 183, 186, 187, 191, 194

[56] References Cited

U.S. PATENT DOCUMENTS

| | | | |
|---|---|---|---|
| 2,940,337 | 6/1960 | Kalb | 74/675 |
| 3,780,925 | 12/1973 | Terkes | 226/191 |
| 3,993,182 | 11/1976 | Steinke | 400/235.1 |
| 4,003,223 | 1/1977 | Vosser | 226/194 |
| 4,003,460 | 1/1977 | Gray et al. | 400/212 |
| 4,047,607 | 9/1977 | Willcox | 400/248 |
| 4,047,608 | 9/1977 | Willcox | 400/248 |
| 4,074,873 | 2/1978 | Hayashi et al. | 242/75.43 |
| 4,147,439 | 4/1979 | Colecchi | 400/234 |
| 4,300,847 | 11/1981 | Hoffman et al. | 400/235.1 |
| 4,350,454 | 9/1982 | Schoenlein | 400/234 |
| 4,391,540 | 7/1983 | Dougherty | 400/216.1 |
| 4,416,560 | 11/1983 | Wood et al. | 400/229 |
| 4,443,124 | 4/1984 | Ozawa | 400/225 |
| 4,472,073 | 9/1984 | Valle et al. | 400/212 |
| 4,486,107 | 12/1984 | Willcox | 400/248 |

FOREIGN PATENT DOCUMENTS

| | | | |
|---|---|---|---|
| 2951534 | 6/1980 | Japan | 400/223 |
| 29485 | 2/1982 | Japan | 400/235.1 |
| 58-191182 | 11/1983 | Japan | 400/196.1 |
| 2079678 | 1/1982 | United Kingdom | 400/229 |

OTHER PUBLICATIONS

R. G. Cross; "Ribbon Drive"; *IBM Technical Disclosure Bulletin;* vol. 15, No. 7, p. 2312; Dec. 1972.

R. A. Rachai; "Ribbon Guides for Minimizing Adhesion"; *IBM Technical Disclosure Bulletin;* vol. 25, No. 2, pp. 464–465; Jul. 1982.

J. A. Smith; "Pinch Rolls for Ribbon Spooling"; *IBM Technical Disclosure Bulletin;* vol. 26, No. 6, pp. 2853–2854; Nov. 1983.

D. W. Reed; "Ribbon Feeding Device"; *IBM Technical Disclosure Bulletin;* vol. 2, No. 5, p. 5; Feb. 1960.

R. E. Hunt; "Cover Sheet Feeding Apparatus"; *IBM Technical Disclosure Bulletin;* vol. 19, No. 10, p. 3630; Mar. 1977.

E. A. Halter et al; "Off-Carrier Ribbon Supply"; *IBM Technical Disclosure Bulletin;* vol. 22, No. 5, p. 1745; Oct. 1979.

J. R. Kirksey et al; "Ribbon Oscillating Guide Mechanism"; *IBM TDB;* vol. 16, No. 5, pp. 1518–1519; Oct. 1973.

*Primary Examiner*—Edgar S. Burr
*Assistant Examiner*—David A. Wiecking
*Attorney, Agent, or Firm*—Kenyon & Kenyon

[57] ABSTRACT

A ribbon supply arrangement for a printer is provided with a first ribbon supply portion having supply and take-up reels therein, the ribbon being provided to a second ribbon supply portion which is installed on a carriage of the printer. In one embodiment, the first ribbon supply portion is pivotally coupled to the second ribbon supply portion, and also pivotally coupled to a pivot coupling on the frame of the printer such that the bulk of the weight of the first ribbon supply portion, including the ribbon supply therein is borne by the frame, and not the print carriage. In a further embodiment, the first ribbon supply portion is provided with a large supply reel and a plurality of take-up reels.

11 Claims, 22 Drawing Figures

31
34
35
33
40
42
41
45
46
20
37
43
44
27
25
38
32
26
23
24
30

Fig. 4A.
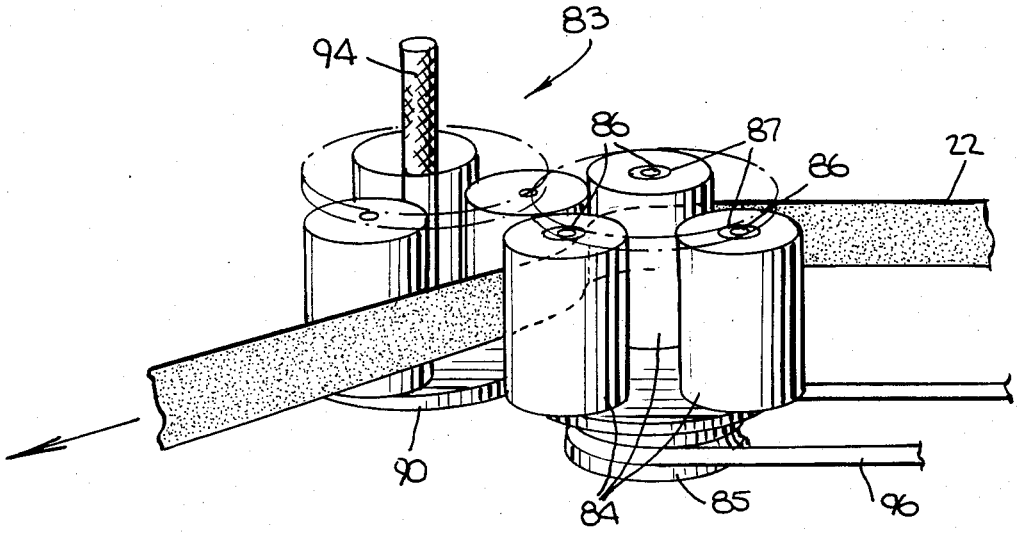
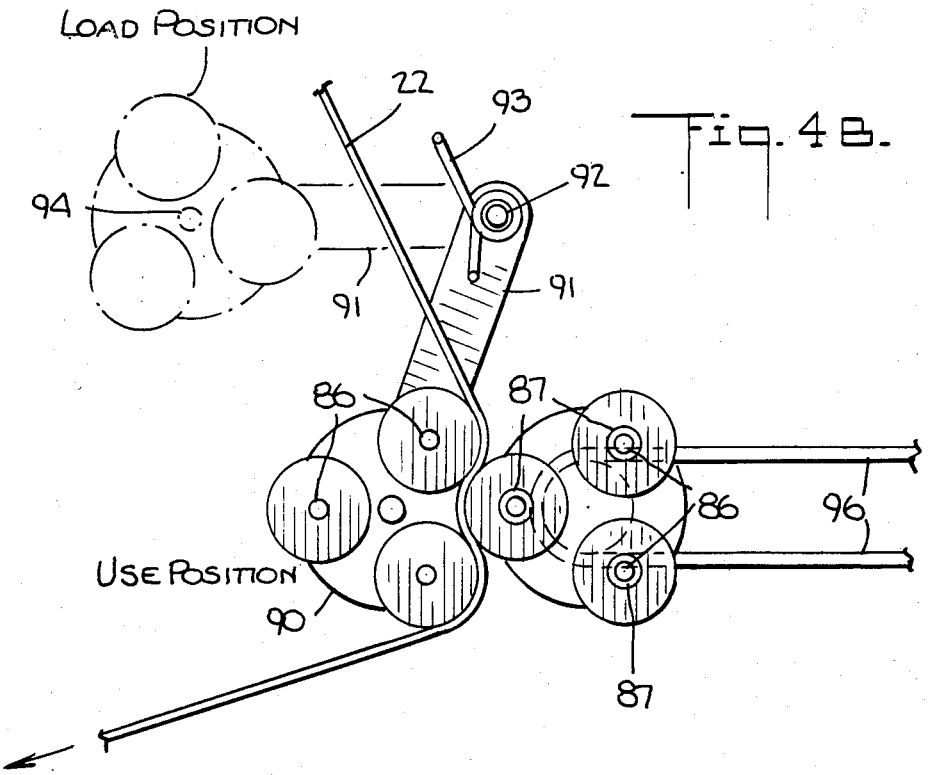
Fig. 4B.

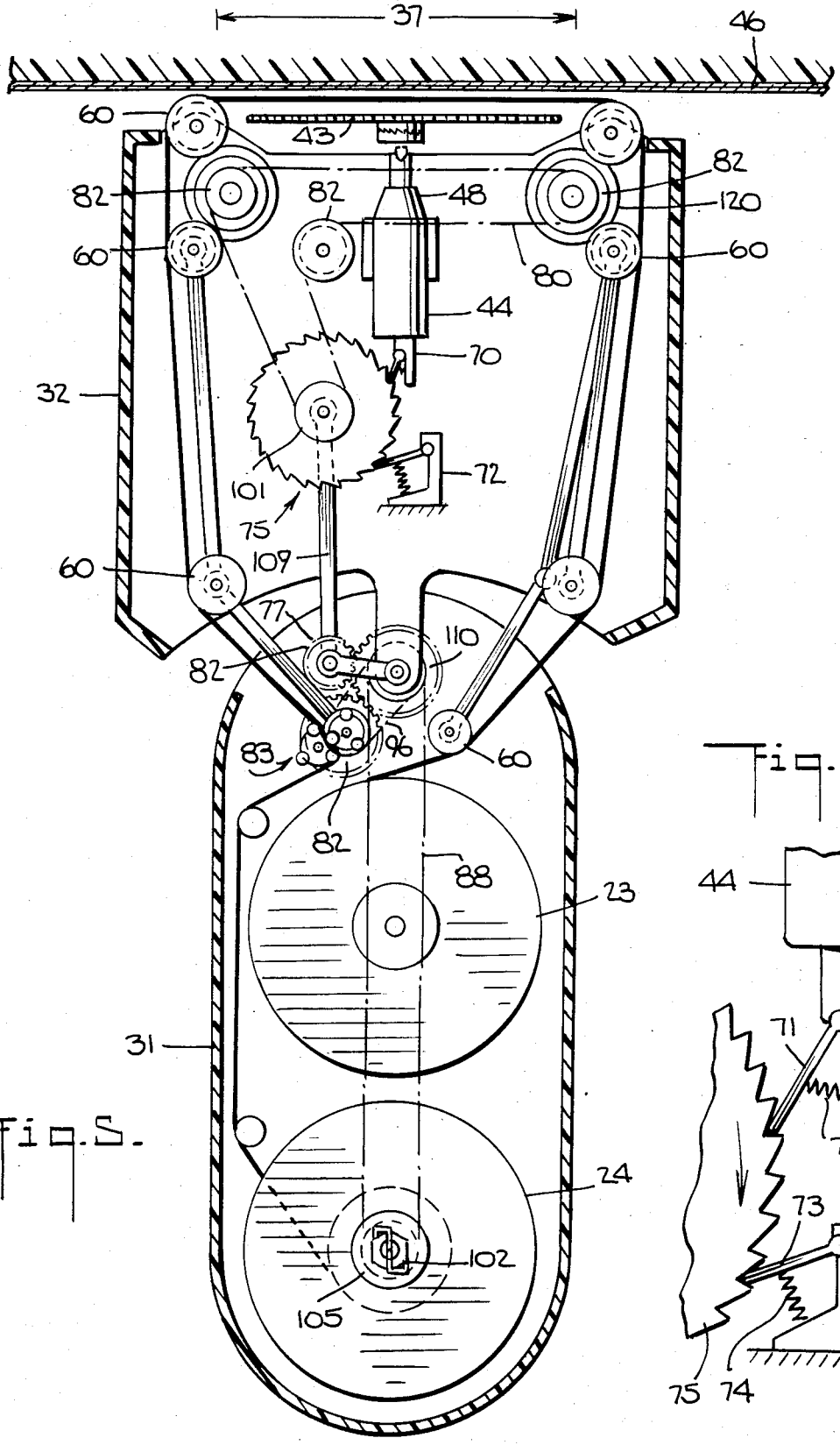
Fig. 5.
Fig. 5A.
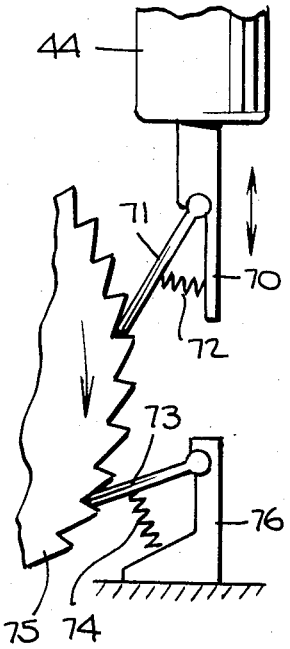

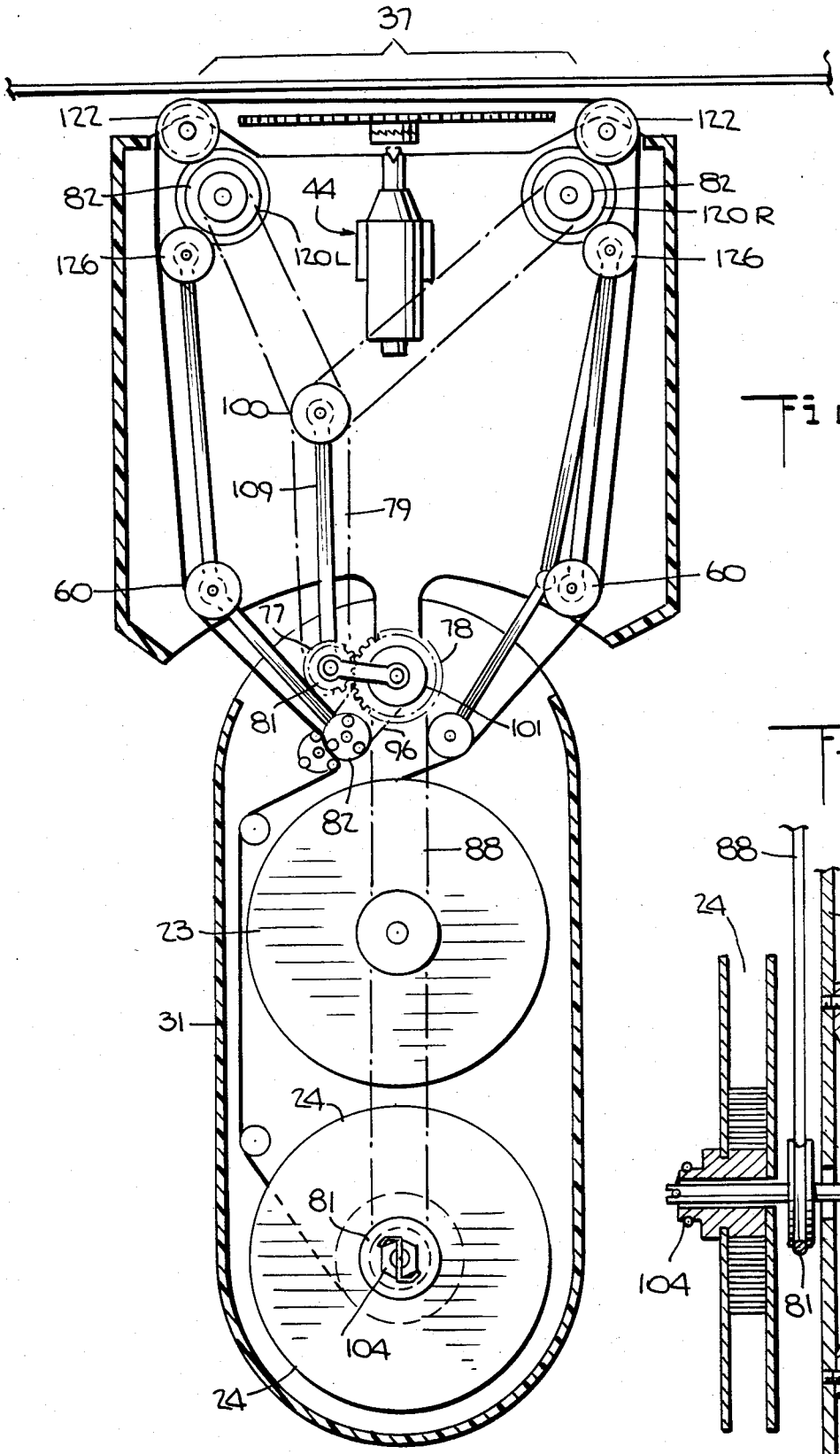
Fig. 6A.
Fig. 6B.
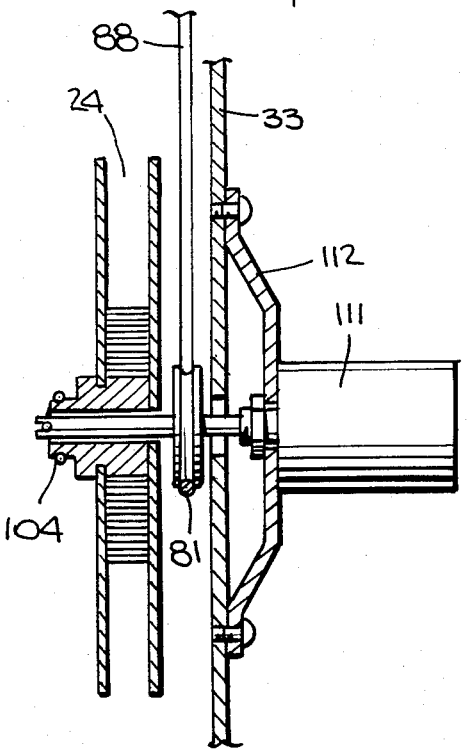

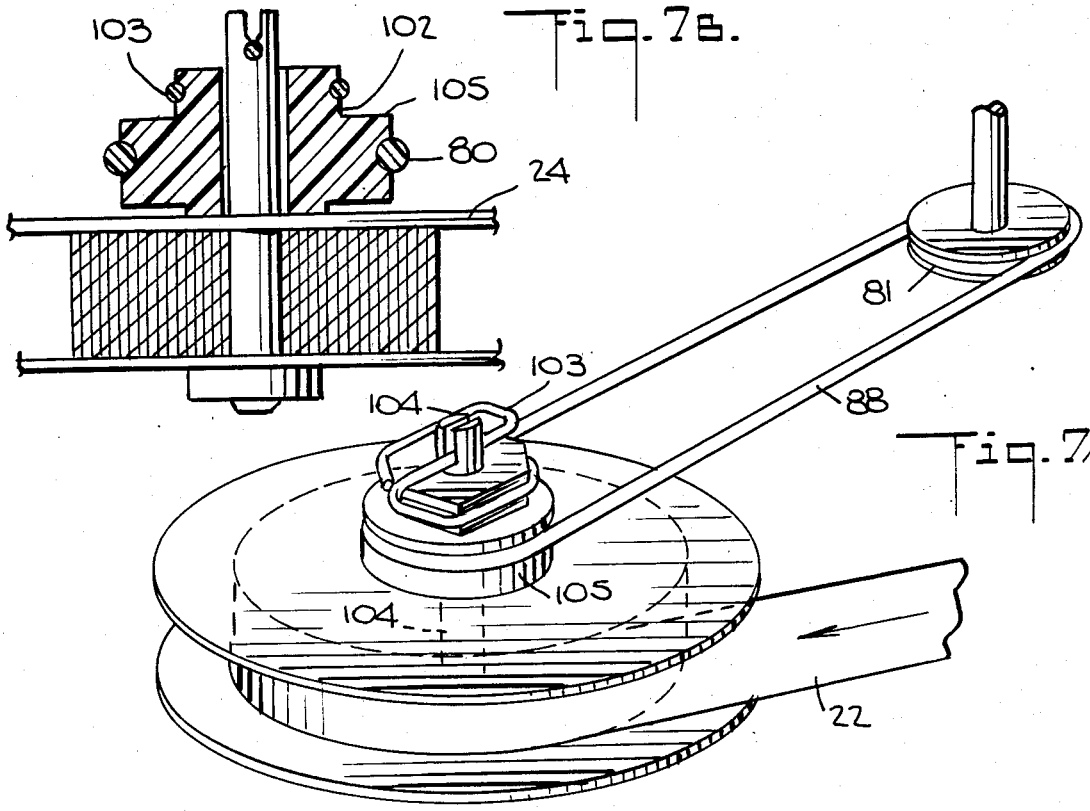
Fig. 7B.
Fig. 7A.
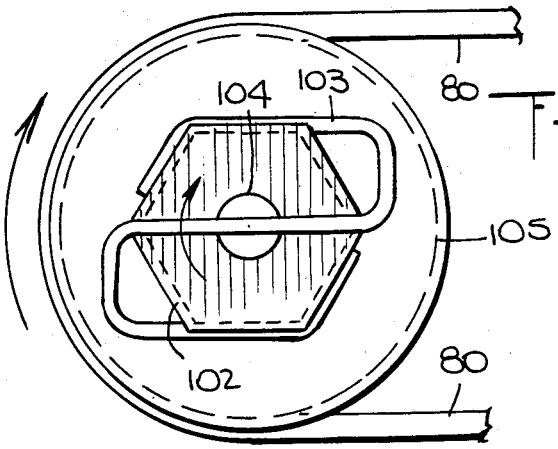
Fig. 7C.
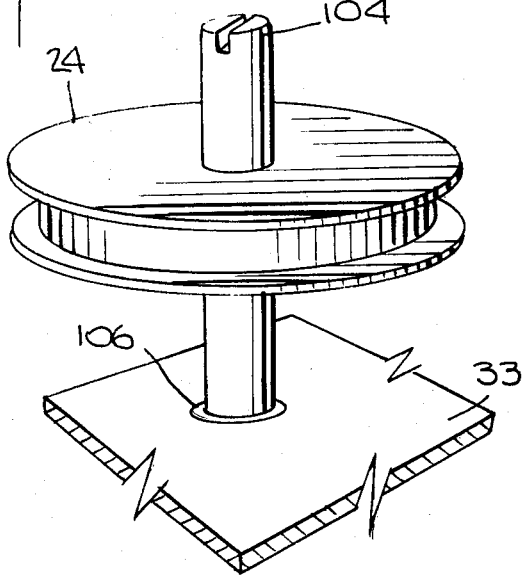
Fig. 7E.
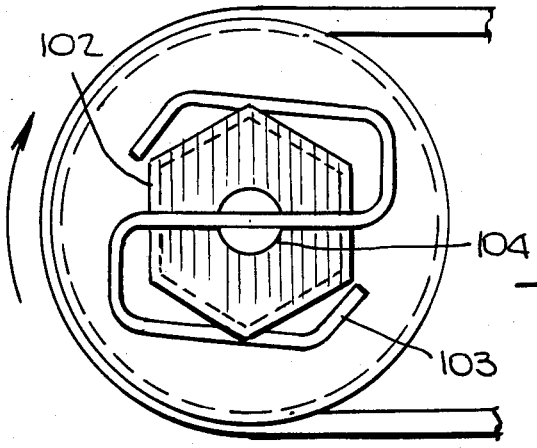
Fig. 7D.

37
117
21
20
122
121
118
126
133
120
124
125
25

123
119
30
122
124
120
125
119
25
80
134
82

126
133
130
125
124
131
132
29

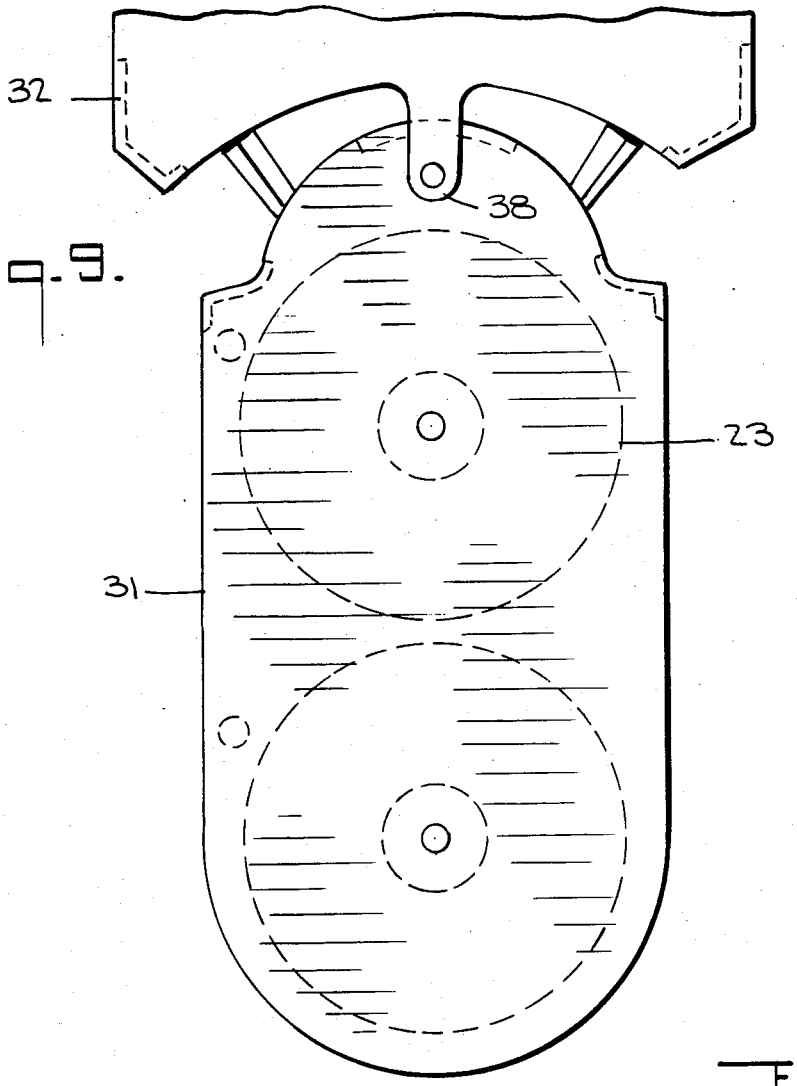
Fig. 9.
Fig. 10.
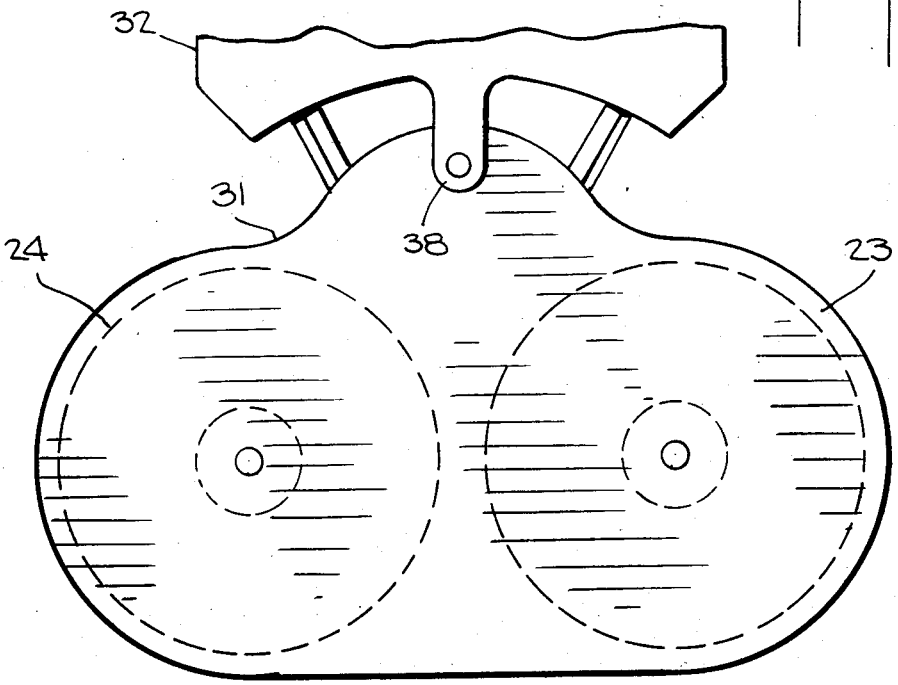

HIGH CAPACITY RIBBON SUPPLY ARRANGEMENT

This application is a continuation of application Ser. No. 570,746, filed Jan. 16, 1984, now abandoned.

BACKGROUND OF THE INVENTION

As the operating speed of printers which are used in conjunction with computers, word processors, and electronic typewriters, is increased through technological advancement, there is a correspondingly increasing need for providing such printers with large stores of printing ribbon. Such a need is particularly acute in printers which use ribbon of the type which has an ink coating on a thin plastic substrate. In contrast to fabric ribbons which may be reused or reinked, the ink coating on full release film ribbons is consumed by the printing process such that a fresh ribbon portion is required for each impact operation of the printer. Even known partial release film ribbons can accept only two or three printing impacts in a given area.

In commercially available printers of the fully-formed character impact type which produce correspondence-quality results, the largest available ribbon supplies are generally on the order of one million characters. Since such correspondence-quality printers may operate at rates of up to sixty characters per second, the useful life of a one million character ribbon supply, in continuous use, in less than five hours. It is therefore evident that in a business environment such correspondence-quality printers require the ribbon to be replaced at least once each day.

The reason why the capacity of a ribbon store in a conventional printer is so limited is simply a matter of bulk and mass. Since printers generally carry the ribbon store on a moving carriage which also carries the printing element and its associated drive components, engineering compromises have to be negotiated between carriage performance and the capacity of the ribbon store. As is well known, the carriages of printers generally travel along a straight path in the vicinity of a stationary platen which supports the paper to be printed when the printing element is driven to impact upon the paper. For each printing position where a character, symbol, or element of punctuation is to be printed, the carriage is moved quickly to that location such that it registers with the print zone of the carriage, and the carriage is stopped during printing. It is therefore evident that the motion of the carriage is discontinuous requiring a substantial number of starts and stops across each line of printing. It is elemental that the acceleration and deceleration characteristics of a body are functions of the mass of the body and its structural configuration. In essence, an increase in the capacity, and therefore the mass, of the ribbon store is achieved at the expense of carriage performance and printer speed.

It is, therefore, an object of this invention to provide a ribbon store for printers which has greater capacity than conventional ribbon stores.

It is another object of this invention to provide a high capacity ribbon storage arrangement which does not substantially degrade carriage performance.

Conventional ribbon supply arrangements are provided with a ribbon drive which causes the ribbon to be transported from a feed reel, past a ribbon utilization area, to a take-up reel. In such known ribbon supply systems, the ribbon is driven by a drive arrangement which rotates the take-up reel so as to wind the used ribbon thereon. Direct coupling of the drive arrangement to the take-up reel has been preferred because other ribbon guide and drive arrangements would require the ribbon to be gripped on both sides by a capstan and a roller, or two rollers. Such a mechanical engagement with the inked side of the ribbon causes the residual ink to be at least partially removed from the film substrate, resulting in an accumulation of ink particles which, as the carriage is moved discontinuously, are distributed throughout the internal mechanism of the printer thereby increasing the frequency of service calls. In addition, irrespective of whether the ribbon is driven by a combination of rollers, or the take-up reel, a driver, such as a stepper motor, must be incorporated on the carriage, further increasing its mass and degrading its performance.

It is therefore a still further object of this invention to provide a drive arrangement for a ribbon which minimizes dislodgment of ink particles from the ribbon.

It is also an object of this invention to provide a drive arrangement which does not require a ribbon drive motor to be arranged on the carriage of the printer.

SUMMARY OF THE INVENTION

The foregoing and other objects are achieved by this invention which provides a ribbon supply arrangement for supplying a ribbon to a moving carriage. The arrangement is provided with first and second ribbon supply portions which are pivotally coupled to one another at a common pivot point. The first ribbon supply portion is provided with a feed reel for supplying the ribbon, and a take-up reel for receiving the ribbon after it has been utilized by apparatus on the moving carriage. The first ribbon supply portion is supported by a chassis support such that at least a portion of the weight of the first ribbon supply portion, which contains the feed and take-up reels, is borne by the chassis support. The second ribbon supply portion is installed on the moving carriage and, in a preferred embodiment, maintains a constant orientation with respect thereto.

In a preferred embodiment of the invention, the first ribbon supply portion is pivotally coupled to the chassis support; the chassis support corresponding to a stationary reference point. However, in some embodiments, the pivoting support on the chassis need not be stationary, and may be moved by additional mechanism so as to follow, to a degree, the translating carriage. By this arrangement, the first and second ribbon supply portions pivot with respect to each other about their common pivot point as the carriage is moved. Thus, the angular orientation between the first and second ribbon supply portions varies in response to the location of the carriage. Additionally, the first ribbon supply portion can serve, in certain embodiments, as a guide for a pivoting motor. Such a pivoting motor for driving a rotatable print element from a location off of the carriage is disclosed in my copending application for U.S. Letters Patent entitled: Rotary Printer With Off-Carriage Motor Drive. The disclosure of my copending application is incorporated herein by reference.

The ribbon is driven along a predetermined ribbon path which, starting from the feed reel in the first ribbon supply portion, extends to the second ribbon supply portion and then returns to the take-up reel in the first ribbon supply portion. In a printer embodiment of the invention, the portion of the ribbon path which is in the second ribbon supply portion includes the interposition of the ribbon between a printing element and a sheet to be printed. In such an embodiment, a hammer is provided on the carriage for striking the printing element and impacting the sheet to be printed via the ribbon in a known manner.

It is inherent in the present ribbon supply arrangement that the distances between the feed reel and the ribbon utilization mechanism, and the take-up reel and the ribbon utilization mechanism, vary in response to carriage translation. The present invention contemplates within its scope a compensating system for maintaining the tension in the ribbon within a predetermined range on either side of the ribbon utilization mechanism. Moreover, such tension control is achieved without displacing the portion of the ribbon at the ribbon utilization mechanism. Thus, the tension control will not adversely affect maximum utilization of the ribbon. On the take-up side of the ribbon utilization mechanism, tension control is achieved by displacing drive and idler members in response to the printing angle at the common pivot between the first and second ribbon supply portions. Compensation for variations in ribbon tension resulting from the pivotal motion between the first and second ribbon supply portions as the carriage is translated is provided on both sides of the ribbon utilization mechanism. On each such side is provided a plurality of pivotally coupled arms which form a guide around which the ribbon travels. One of the arms on each side is arranged to traverse between the first and second ribbon supply portions. The traversing arm on the take-up side of the ribbon utilization mechanism is coupled to the ribbon drive and idler members, which will be described below. Thus, ribbon tension on the take-up side is controlled by displacing the mechanism which draws the ribbon. On the feed side of the ribbon utilization mechanism, tension control is achieved by a resilient dancer member which, in one embodiment, is coupled to the hub of the feed reel by a cable. The cable, which may be formed of nylon, is wound around a ridged or textured pulley in the hub . tthe feed reel and coupled to the resilient dancer member. In this manner, the cable and the textured pulley perform as a self-compensating brake whereby the feed reel is braked when the resilient dancer member is permitted to draw the cable taut by the presence of slack in the ribbon. As the slack in the ribbon is taken up, the resilient member is moved in a direction which tends to release the hub of the feed reel, thereby allowing it to be rotated in response to the tension in the ribbon.

In a particularly advantageous embodiment of the invention, a reciprocating motion of the hammer is utilized to drive the ribbon. The ribbon is gripped by the drive and idler members which rotate about respective axes of rotation. The drive and idler members are each provided with a plurality of ribbon engagement members which are arranged radially about the respective drive and idler members, and are meshed with one another. In a preferred embodiment, the ribbon engagement members are formed of a polymeric material, illustratively Delrin (trademark of DuPont). The ribbon is interposed between the meshed ribbon engagement members. The reciprocating motion of the hammer is converted into rotary motion which is coupled to drive the drive member. In addition, such rotary motion also drives the take-up reel. To facilitate replacement of the ribbon, the drive and idler members can be separated from one another such that the ribbon can be removed from therebetween while the respective ribbon engagement members are unmeshed. The ribbon engagement members each have a curved surface in their respective regions where they engage the ribbon. Such curved surfaces are configured to minimize tensile stress and pressure on the ribbon which would otherwise dislodge ink particles from the ribbon substrate, while permitting the ribbon to be gripped sufficiently firmly to move it along the ribbon path. In a preferred embodiment, such ribbon engagement members are cylindrical rollers which are free to rotate about respective axes.

The take-up reel is driven to wind the ribbon thereon via a slip clutch which is formed by the engagement of first and second clutch portions. The first clutch portion has a plurality of slip surfaces which are arranged to have the cross-sectional configuration of a polygon. The second clutch portion is a resilient member which is adapted to slip on the slip surfaces of the first portion. The resilient member may be shaped to correspond with at least a portion of the perimeter of the cross-sectional polygon.

In accordance with a further aspect of the invention, the ribbon has a sufficient width to contain several longitudinal tracks on which the characters are printed serially. A shift arrangement, in the form of a track selector, is provided for selecting one of the ribbon tracks whereby the ribbon is moved so that a selected track registers with the print zone of the printer. The second portion of the ribbon supply arrangement, which is located on the moving carriage, is provided with mechanism for moving the ribbon in a direction which is essentially orthogonal to its longitudinal direction. The shift arrangement is provided with a shift drive which produces a displacement. In a preferred embodiment, the shift drive contains a pair of cylindrical axial cams arranged on either side of the print zone and which communicate with respective ribbon lift guides, illustratively in the form of guide rollers. As the axial cams are rotated, their respectively associated ribbon lift guides are moved in the desired shift direction.

In a preferred embodiment, the cylindrical axial cams are provided with respective disc cams arranged circumferentially thereabout. The disc cams communicate with a pair of tilt guides which support the ribbon as it is shifted from a reference height to a height corresponding to a selected track. In a preferred embodiment, the ribbon lift guides and the tilt guides are rollers which are free to rotate about the respective shafts.

It is an important aspect of the present invention that the first ribbon supply portion need not be pivotally coupled directly to the second ribbon supply portion, or to the chassis of the printer. Moreover, the first and second ribbon supply portions need not be either coplanar or on parallel planes. For example, the first ribbon supply portion may extend downwardly from the second ribbon supply portion so as to be essentially orthogonal thereto. This downwardly depending first portion may be supported at its lowermost end by a track or groove on the chasis of the printer; the first portion of the ribbon supply being urged therealong in response to the motion of the carriage.

The feed and take-up reels can be arranged either coaxially or coplanarly within the first ribbon supply portion, as desired. In one such orthogonal embodiment, the second ribbon supply portion is arranged to travel with the carriage, as described hereinabove with respect to other embodiments of the invention, while the first ribbon supply portion, which contains the feed and take-up reels, is arranged to depend substantially orthogonally from the second ribbon supply portion. The first and second ribbon supply portions are coupled to one another by a coupling element which may be in the form of a spring which applies a resiliently increasing counterforce against excessive pivotal displacement between the first and second ribbon supply portions. Alternatively, non-resilient pivotal linkage may be utilized. The use of resilient coupling is preferred because it allows a lag effect to be achieved in the portion of the first ribbon supply portion to be delayed until the torque of the drive motor has developed somewhat with speed. In other words, resilient coupling allows operation of the arrangement at a higher point in the torque-speed curve.

In one highly advantageous embodiment, the lateral translation of the first ribbon supply portion can be coupled to a stepped drive for the ribbon, so that the ribbon drive motor, which may be of the stepper type, can be arranged off of the carriage to reduce carriage mass. This is achieved by the use of a planetary gear system having a ring gear which surrounds the planetary gears and which is coupled via a flexible drive cable to the first ribbon supply portion. A ring member which couples the centers of the planetary gears is coupled via flexible drive cable to a ribbon drive arrangement in the first ribbon supply portion. The ribbon stepper drive motor is coupled to the sun gear. Thus, when it is desired to step the ribbon, the rotary motion of the drive motor is coupled to the ring member, which subsequently drives the ribbon drive arrangement. However, when it is desired to translate the carriage without stepping the ribbon, such as during carriage return or tab motion, the motor locks the sun gear so as to counteract the rotation of the ring gear, such that the ring member coupling the planetary gears moves only sufficiently to move the flexible drive cable without actuating the ribbon drive. In some embodiments, the motor frame may be rotated to compensate for such carriage translation.

BRIEF DESCRIPTION OF THE DRAWINGS

Comprehension of the invention is facilitated by reading the following detailed description in conjunction with the annexed drawings, in which:

FIGS. 4A and 4B are isometric and top plan views of an arrangement for engaging and pulling ribbon;

FIG. 5 is a top plan view of an overall ribbon supply arrangement;

FIGS. 6A and 6B illustrate the motor drive of the ribbon supply arrangement;

FIGS. 7A, 7B, 7C, 7D, and 7E are isometric, cross-sectional, and plan views of selected details of a take-up reel drive clutch arrangement;

FIG. 9 is a top plan schematic representation of an embodiment of first ribbon supply portion having large ribbon reels arranged orthogonal to the direction of carriage travel;

FIG. 10 is a top plan schematic representation of an embodiment of a first ribbon supply portion having large reels arranged in parallel with the direction of carriage travel;

DETAILED DESCRIPTION

Figures 1A, 1B:
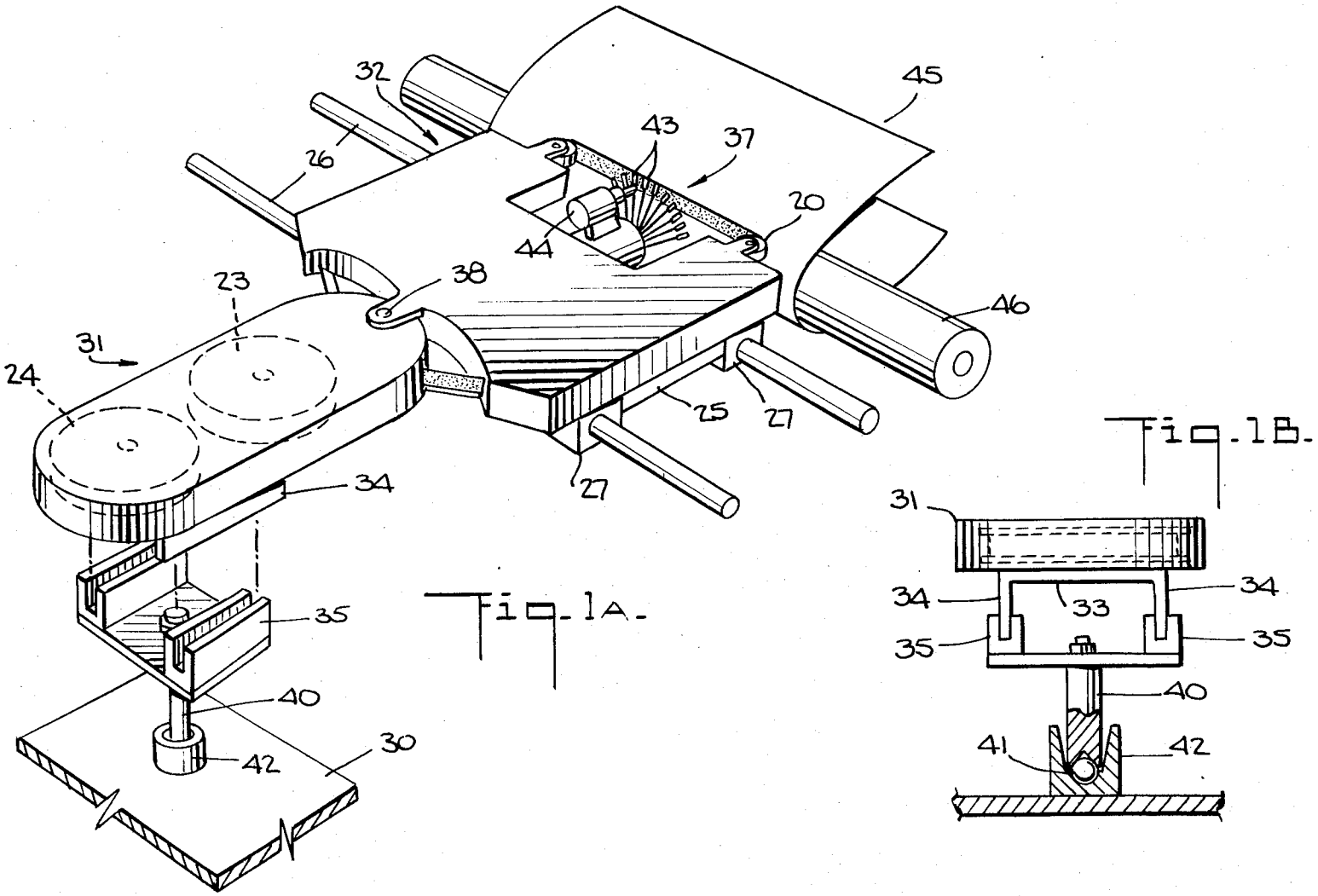
FIGS. 1A and 1B are isometric and cross-sectional plan views of one embodiment of the invention showing a ribbon supply arrangement having a first ribbon supply portion which is pivotally coupled to a frame member, and pivotally coupled to a second ribbon supply portion which travels with a print carriage.

FIG. 1A is an isometric representation of an embodiment of the invention showing first and second ribbon supply portions 31 and 32, which are coupled to one another at a pivot coupling 38. A printable sheet 45, which may be a sheet of paper to be printed upon, is wrapped around a platen 46 which in this embodiment, has a cylindrical configuration. A hammer 44 is provided for impacting a print element 43 whereby a ribbon 20 arranged in a ribbon utilization zone 37 is impacted by the print element onto printable sheet 45. Since ribbon 20 is interposed between printable sheet 45 and print element 43, a selected character on the print element is thus applied to the printable sheet in a conventional manner. In this embodiment, platen 46 is rotatable about a longitudinal axis, but is affixed to be laterally stationary. A carriage 25 is arranged on a set of linear bearings 27 and installed on a pair of cross rails 26 so as to permit motion of the entire printing apparatus laterally to a next desired printing location.

As shown in FIG. 1, second ribbon supply portion 32 is mounted upon carriage 25 and, via pivot coupling 38, is pivotally joined to first ribbon supply portion 31. First ribbon supply portion 31 has a supporting frame 33 which is shown in the partially fragmented end view of FIG. 1B. Frame 33 is mounted on a guideway 34 such that guideway 34 slides within a lower guideway 35 mounted on a lower guideway support 40. In this embodiment, lower guideway support 40 is cylindrical and fits within a cylindrical recess of a chassis receiver cup 42 above a lower guideway pivot ball 41. Chassis receiver cup 42 is mounted directly on a chassis 30 at the base of the frame of the printer arrangement.

Figure 2:
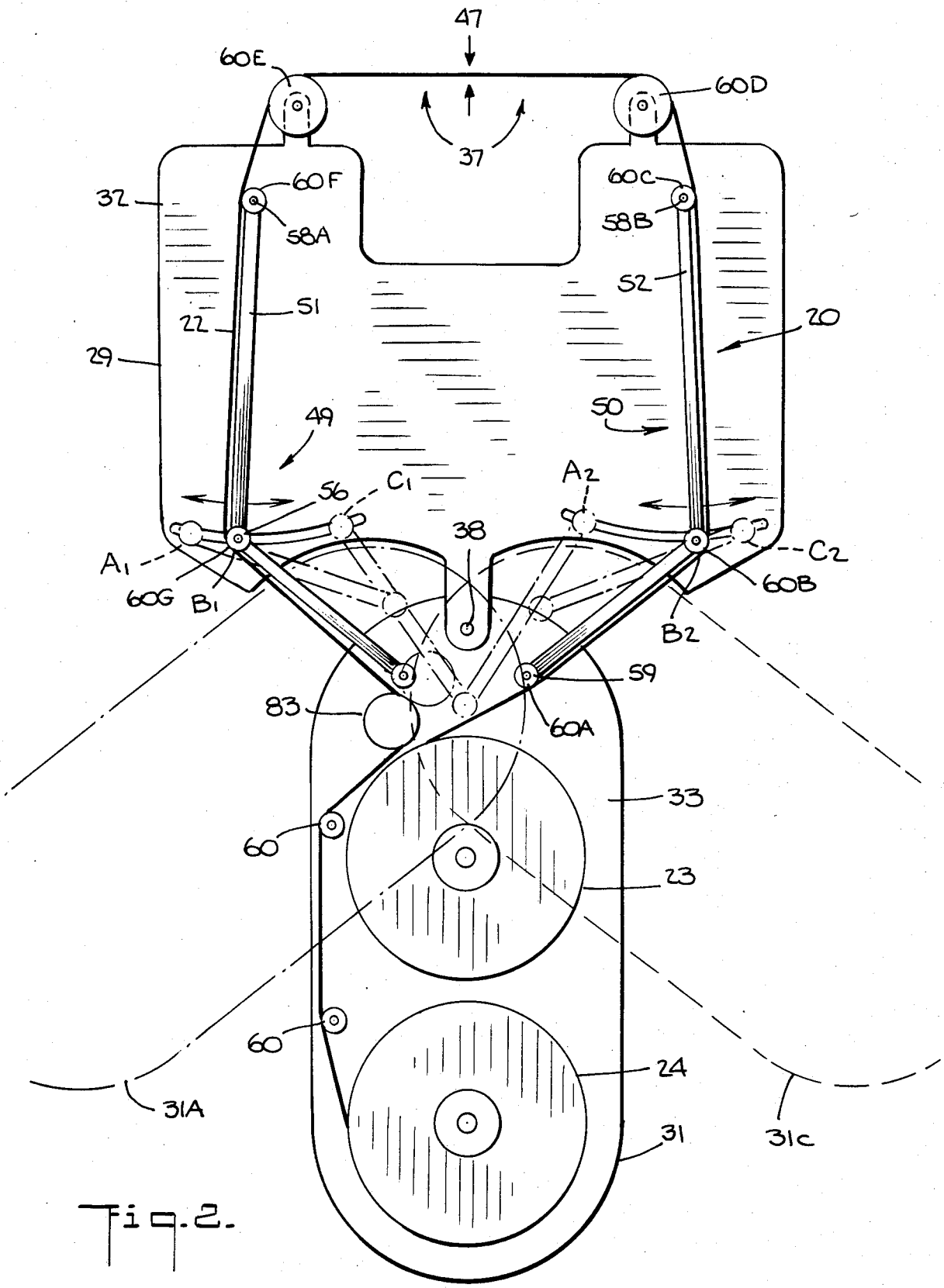
FIG. 2 is a top plan view of the embodiment of FIGS. 1A and 1B showing relative angular motion between the first and second ribbon supply portions.

FIG. 2 is a top plan view showing technical details of first and second ribbon supply portions 31 and 22. When carriage 25 is in the center of its lateral excursion, first ribbon supply portion 32 is in position "B", such that, in this embodiment, the first and second ribbon portions are in longitudinal alignment. When carriage 25 is located at the rightmost extreme of its lateral travel, first ribbon supply portion 31 assumes a position identified as "A" which is indicated by a dash-dotted line in this figure. Similarly, when carriage 25 assumes a leftmost extreme position, first ribbon supply portion 31 assumes an orientation shown in the figure by an outline identified as "C".

In this embodiment, ribbon 20 is supplied by a feed roll 23 which supplies the ribbon toward a ribbon utilization zone 37. Ribbon 20 first passes by a ribbon guide pulley 60A mounted above a ribbon pulley shaft 59 on a lower right compensator swing arm 54. The ribbon then passes by a ribbon pulley guide 60B above a right common pivot shaft 55 which rotatably joins lower right compensator swing arm 54 and an upper right compensator swing arm 52. Ribbon 20 continues along a path which proceeds around a ribbon guide pulley 60C above a top arm pivot 58B mounted to a second portion frame 29. Ribbon 20 then continues around a ribbon guide pulley 60B into ribbon utilization zone 37 towards a print point 47 where printing is effected.

As first ribbon supply portion 31 angulates between positions "A" and "C" during lateral travel of second ribbon supply portion 32, which travels with carriage 25, the pivoting about right pivot shaft 55 causes the pivot shaft to move to corresponding positions $A_2$, $B_2$, and $C_2$. The other ends of pivotally joined upper right compensator swing arm 52 and lower right compensator swing arm 54 are pivotally affixed to the second and first ribbon supply portions, respectively, at respective frames thereof, 29 and 33. After use at a print point 47, the used ribbon 22 passes around a ribbon guide pulley 60E, then around a ribbon guide pulley 60F above a top pivot arm 58A. Subsequently, the ribbon passes around a ribbon guide pulley 60G above a left common pivot shaft 56, and finally to a ribbon pull engagement unit 83 is shown only schematically in this figure.

The angulation of first ribbon supply portion 31 with respect to second ribbon supply portion 32 causes angular movement of an upper left compensator swing arm 51 which is pivotally affixed to frame 29 by a pivot 58A and to lower left compensator swing arm 53 by left pivot shaft 55 which assumes corresponding positions $A_1$, $B_1$, and $C_1$.

The fixed total lengths of a pivotally joined left angulation compensation system 49, or a right angulation system 50, ensures that ribbon 20, at print point 47 will not move laterally as a result of the angulation movements of first ribbon supply portion 31 with respect to second ribbon supply portion 32.

Figure 3:
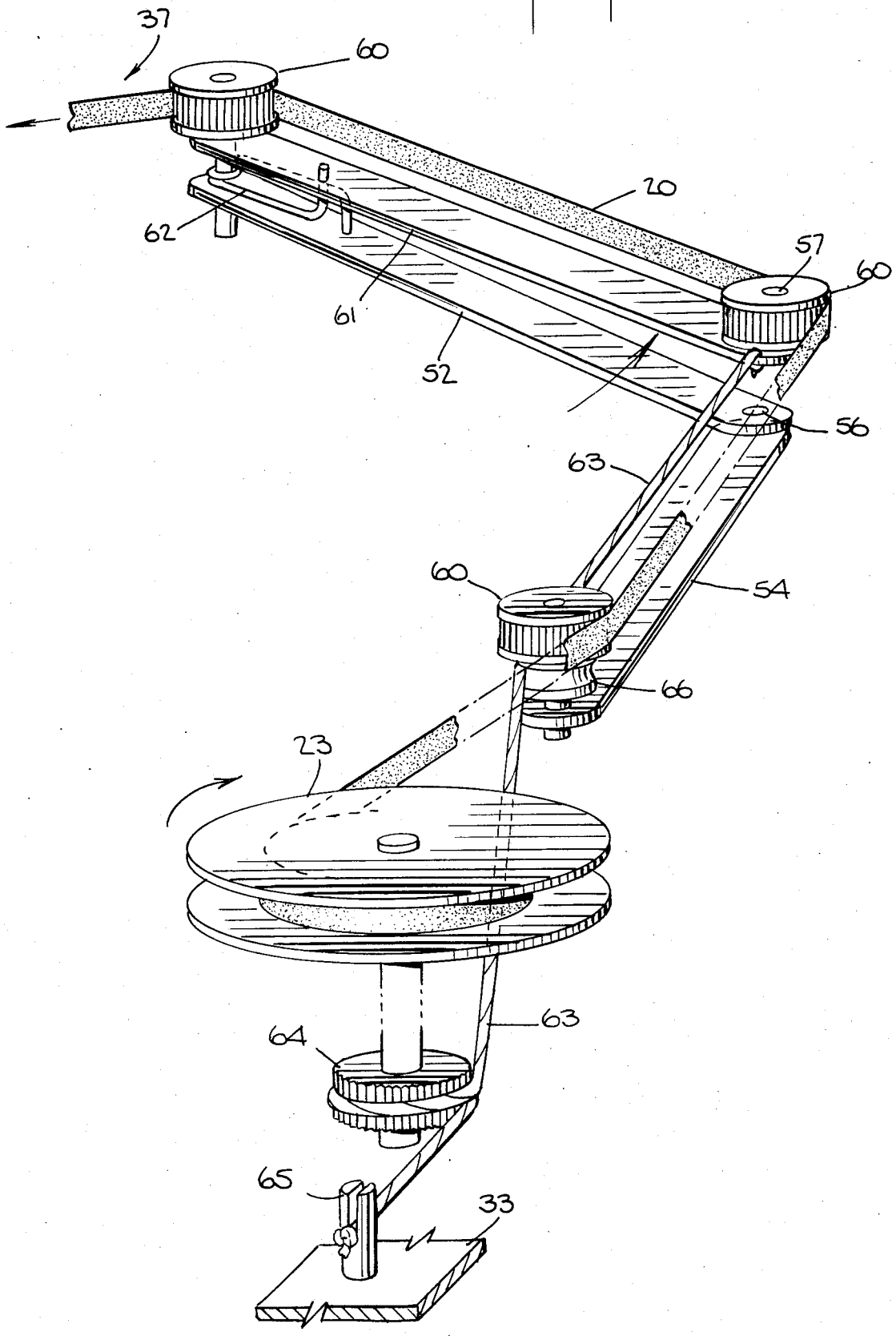
FIG. 3 is an isometric representation of a ribbon control arrangement which compensates for angular change between the first and second ribbon supply portions, and ribbon slack.

FIG. 3 is an exploded isometric representation of the details of feed reel 23 and ribbon feed control. Ribbon guide pulley 60, which was described with respect to FIG. 2 as being on right pivot shaft 55, is shown in FIG. 3 as being on the end of a dancer arm 61 and engaged with a dancer swing and pivot shaft 57. Right common pivot shaft 56 is joined with right compensator swing arm 52 and lower right compensator swing arm 54. Dancer arm 61 is biased counterclockwise by a dancer spring 62 so as to measure tension in this portion of ribbon 20 from feed reel 23. A feed hub clutch cable 63, which may be formed of solid or stranded polymeric material, such as nylon, is affixed to the swinging end of dancer arm 61. Feed hub clutch cable 63 passes around a cable idler pulley 66 and then around a slightly ridged clutch pulley 64. The end of feed clutch cable 63 is affixed to frame 33 of the first ribbon supply portion by a cable post 65.

When the tension in ribbon 20 between feed reel 23 and ribbon utilization zone 37 is low, dancer arm 61 swings counterclockwise under bias of dancer spring 62, thereby tensioning feed hub clutch cable 63 so that it tightens on ridged clutch pulley 64, thereby preventing feed reel 23 from turning. This continues until enough ribbon 20 has been pulled into ribbon utilization zone 37 by take-up motion of ribbon pull engagement unit 83, which places pressure against dancer spring 62, swinging dancer arm 61 clockwise, and loosening feed hub clutch cable 63 on ridged clutch pulley 54. This operation allows feed reel 23 to begin turning again, thereby supplying more ribbon 20. In practice, only minor movements of dancer arm 61 occur, and an intermediate frictional level of feed clutch cable 63 on ridged clutch pulley 64 is achieved during a steady run of printing operations.

FIGS. 4A and 4B are isometric and top plan views of a ribbon puller arrangement. Ribbon 20 is pulled past ribbon utilization zone 37 by a ribbon pull engagement unit 83. Ribbon pull engagement unit 83 is comprised of an engagement roller drive disc 85 and an engagement roller driven disc 90. Each disc has a set of three engagement rollers 84 mounted on the upper side thereof; each engagement roller 84 being mounted on an engagement roller pin 86. Engagement rollers 84 on drive disc 85 have an engagement roller spring clutch 87 above engagement roller pin 86 so as to turn in only one direction, whereas the three engagement rollers 86 on engagement roller driven 90 may rotate freely in either direction.

Engagement roller drive disc 85 is rotated by an engagement roller drive belt 96, which is driven by the ribbon drive system discussed with respect to FIG. 5 and FIG. 6. Engagement roller driven disc 90 is rotatably mounted on the end of a driven disc pivot arm 91. Driven disc pivot arm 91 is rotated about a driven disc arm pivot 92, and a driven disc arm spring 93 biases engagement roller driven disc 90 so as to have rim contact with engagement roller drive disc 85. As engagement rollers 84 project beyond the rims of the two engagement discs 85 and 90, when engagement roller disc 85 is caused to rotate by the ribbon drive system, the line contact pressure between engagement rollers 84 and the two discs forces the engagement roller driven disc to rotate as well. When a driven disc loading handle 94 is used to swing engagement roller driven disc 90 outward against the mechanical bias of driven disc arm spring 93, there is then sufficient clearance between engagement roller drive disc 85 and engagement roller driven disc 90 to allow easy placement of used ribbon 22 therebetween. The pressure between meeting engagement rollers 84 is sufficient to hold used ribbon 22 firmly so as to pull it around the ribbon supply system from feed reel 23.

As the gripping action is in the form of a rolling grip between engagement rollers 84, used ribbon 22 is not substantially distorted, and therefore very little ink particle debris is created. Moreover, this arrangement reduces the ribbon take-up drive jamming which is common in other systems, such as known meshed gear crimpers.

FIG. 5 is a top plan view of a ribbon drive arrangement which utilizes the hammer retraction force. When an actuating solenoid (not shown) of hammer 44 is energized, an armature 48 will extend towards the back of a print element 43. Since the next print cycle cannot occur until armature 48 is retracted, a large restoring spring is commonly used which is larger than the largest energizing force used for a large-area character or symbol. Such an arrangement usually requires a large elastomeric damping block for absorbing excess retract cycle energy. In this system, a hammer armature rear extension 70 is provided. Mounted on rear extension 70 is a drive plate 71 which is biased toward a ratchet gear 75 by a drive plate spring 72. In this manner, rearward motion of armature 48 will cause hammer armature rear extension to move rearward, and drive plate 71 will engage ratchet gear 75 causing it to rotate clockwise. An escapement plate 73 is mounted pivotally on an escapement base 76 with an escapement spring 74 biasing escapement plate 73 into engagement with ratchet gear 75 so that it cannot rotate counterclockwise. It should be noted that the ratchet gear is shown to have large teeth for the sake of illustrative simplicity. In practice, however, the teeth would be very much smaller such that an increment of rotation which is generated by one rearward movement of drive plate 71 would correspond to several teeth of the ratchet gear.

Rotary motion of ratchet gear 75 is coupled to the ribbon drive system of a dual pulley 101 mounted on ratchet gear 75. Rotation of dual pulley 101 causes an upper drive belt 80 to move, thereby causing a set of driven pulley 82 to rotate. Two of driven pulleys 82 rotate a pair of ribbon lift cylindrical axial cams 120 which will be described in greater detail with respect to FIG. 8, hereinbelow. The other half of dual pulley 101 causes lower drive belt 79 to move, thereby rotating driven pulley 82 mounted on a gear 77. The rotation of gear 77 mounted on a joining pivot between the free ends of a ribbon drive long swing arm 109 and a ribbon drive shorter swing arm 110 causes a meshing gear 78 to rotate. Gear 78 is mounted on the axis of pivot of first ribbon supply portion 31, coaxially with pivot 38, so that the angulation motion of first ribbon supply portion 31 with respect to second ribbon supply portion 32 does not cause that motion of the ribbon drive belt. A dual pulley 101 is coupled to gear 78 such that the rotation of the dual pulley causes a take-up reel belt 88 and a drive belt 96 to move. Take-up reel belt 88 rotates a take-up reel 24 from the hammer retraction motion, and drive belt 96 rotates ribbon pull engagement unit 83.

FIGS. 6A and 6B are top plan and cross-sectional side views of an embodiment of the invention having an off-carriage ribbon drive motor 111. In this embodiment, the rebound drive movement is replaced by an off-carriage ribbon drive motor which may be of the "stepper" type. Each step of this motor, in one embodiment, may correspond to the minimum distance of ribbon advance; which distance may be as small as 1/9th of a character width. In such an embodiment, the placement of the stepper motor at the pivot location obviates the difficulties generally encountered with the use of such stepper motors. Generally, it is difficult to achieve a speed of over 100 characters per second, particularly in proportional spacing embodiments having n steps per character, where n varies between 1 and 9. Such a speed requirement, which represents up to 900 steps per second, is achievable only by a large motor which has too much bulk and mass for the moving carriage to carry. In accordance with an embodiment of the invention, however, the motor is almost entirely over the pivot, and therefore the moving carriage sees only the inertial resistance to change in angular motion, and not the weight of the motor. Thus, any suitable motor can now be used, its selection being based upon cost, and not weight or size.

In this embodiment, ribbon drive motor 111 is shown on a ribbon drive mounting plate 112 fastened to frame 33 of the first ribbon supply portion. FIG. 6B shows a side view of the present arrangement in the vicinity of ribbon drive motor 111. Ribbon drive motor 111 has a slotted rotary shaft 104 which extends up through the hub of take-up reel 24 and is coupled to take-up reel 24 by a polygon slip clutch discussed hereinbelow with respect to FIG. 7. In FIGS. 6A and 6B, take-up reel belt 88 drives dual pulley 101 coupled to gear 78 so as to drive ribbon pull engagement unit 83 through engagement roller drive belt 96 and the ribbon drive components in first ribbon supply portion 31 through meshed gear 77. Rotation of gear 77 causes drive pulley 81 to rotate, thereby moving upper drive belt 79 which is coupled to a triple pulley 100. Triple pulley 100 rotates, moving both drive belt 80L connected to ribbon lift cylindrical axial cam 120L, and drive belt 80R, connected to drive lift cylindrical axial cam 120R. Meshed gear 78 and gear 77, which are mounted at the junction of ribbon drive long swing arm 109 and ribbon drive shorter swing arm 110, remove any components of angulation from the ribbon motion components during relative angular movement between the first and second ribbon supply portions.

FIGS. 7A–7E are isometric, cross-sectional, and plan views of various details of the take-up ribbon reel drive clutch. In order to preserve the clarity of the drawing, take-up reel belt 88 is shown above take-up reel 24, but in a practicable embodiment, the take-up reel belt would be located on the underside of frame 33 of the first ribbon supply portion to facilitate the loading of new ribbon reels.

In these figures, the initially free end of used ribbon 22 is affixed to a take-up hub 105 of take-up reel 24. Rotational power is coupled from a ribbon drive source which is shown schematically as drive pulley 81, and coupled to take-up hub 105 by a take-up reel belt 88. Take-up hub 105 is not connected to take-up reel 24 directly, and can turn freely on slotted rotary shaft 104. Slotted rotary shaft 104 is connected to the base of take-up reel 24 and extends through a base bearing 106 in frame 33 of the first ribbon supply portion, so as to act as a rotational axis for take-up reel 24. The topmost portion of take-up hub 105 is shaped into a slip clutch polygon 102. In a preferred embodiment, the polygon is formed of a somewhat lubricious, yet durable plastic, such as "Delrin," a DuPont product.

A resilient clip engager 103 which may be formed of a spring rod having a diameter of approximately 0.060 inches, grips the faces of slip clutch polygon 102, so as to rotate take-up reel 24 to a predetermined torque which is sufficient to wind used ribbon 22 efficiently, yet remain well below a braking load of ribbon 22. The clutch described herein slips only when the torque exceeds the amount needed to spread the clip, such as when the ribbon is stopped. It is desirable that the source drive rotate the take-up reel 24 at a speed such that when the ribbon is affixed to the hub the take-up reel is rotated sufficiently fast to wind thereon all ribbon which is delivered by ribbon pull engagement unit 83. In this manner, when the take-up reel is nearly full, the amount of ribbon taken up per revolution is markedly greater. The polygon grip clutch will slip nearly continuously when the reel is almost full. Thus, there should be sufficient faces on the polygon to provide a moderate number of pulses per revolution of the drive source, so that no sharply intermittent loads are transmitted back to the drive source.

Figures 8A, 8B, 8C:
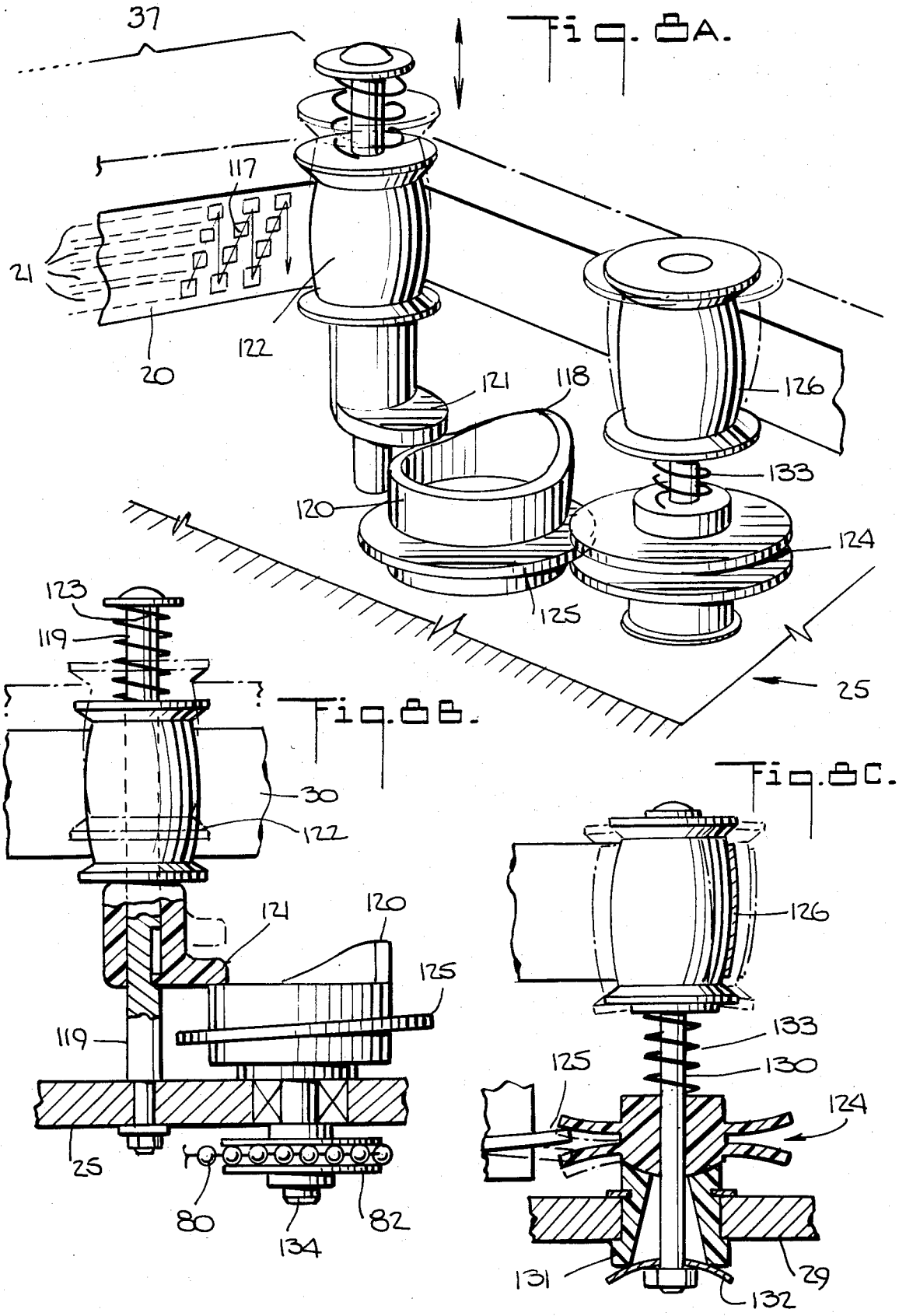
FIGS. 8A, 8B, and 8C are isometric and crosssectional representations of a ribbon lift and tilt arrangement.

FIGS. 8A, 8B, and 8C show isometric and crosssectional views of a ribbon lift and tilt system which, in one embodiment, is contained in the second ribbon supply portion. Such an arrangement is used in embodiments of the invention where the width of the ribbon is greater than the height of the print zone such that various printing tracks may be arranged on the ribbon. In one specific illustrative embodiment, the print zone has a height dimension on the order of 0.2 inches.

As shown in FIG. 8A, ribbon 20 passes by a ribbon tilt pulley 126, and then to a ribbon lift pulley 122 so as to be past in the vicinity of a ribbon utilization zone 37. In this embodiment, the width of ribbon 20 allows a sawtooth utilization pattern 117 which is achieved by programming the vertical lift of ribbon lift pulley 122 through the use of an axial cam pattern 118 on a ribbon lift cylindrical axial cam 120. A ribbon lift cam rider 121 is arranged just below ribbon lift pulley 122 on a ribbon lift shaft 119 which is visible in FIG. 8B.

When ribbon lift cam rider 121 is moved vertically by the operation of axial cam pattern 118 during rotation of ribbon lift cylindrical axial cam 120, a ribbon lift spring 123 above ribbon lift pulley 122 ensures that both ribbon lift cam rider 121 and ribbon lift pulley 122 move vertically together. Rotating ribbon lift cylindrical axial cam 120 also rotates a cylindrical programming surface 125. Ribbon tilt pulley 126 is mounted on a ribbon tilt shaft 130 passing through a tilt shaft cone mount 131 affixed to frame 29 of the second ribbon supply portion. The lower extremity of ribbon tilt shaft 130 is secured by a dome-shaped cone mount spring washer 132 which may be of the well known "Belleville" type. The lower surface of a ribbon tilt guide angle cam 124 has a matching spherical shape. Both upper and lower dome surfaces may be coated with a lubricious surface coating, such as DuPont Delrin or Teflon so as to mate with the upper surface of ribbon tilt guide angle cam 124 and allow ribbon tilt shaft 119 to tilt with little friction. A tilt shaft spring 133 holds ribbon tilt pulley 126 against the upper retainer head of ribbon tilt shaft 130. In this manner, as ribbon lift cylindrical axial cam 120 is rotated by a cam unit shaft 134 bearing driven pulley 82 which is moved by upper drive belt 80, the cam follower lips of ribbon tilt guide angle cam 124 are moved by tilt programming surface 125. As ribbon 20 is supplied from a fixed height feed reel 23, ribbon tilt pulley 126 will adapt the fixed supply height of ribbon 20 so as meet ribbon lift pulley 22 properly at its various heights and thereby achieve ribbon sawtooth use pattern 117. The same tilt and lift mechanism is also provided at the left end of the ribbon utilization zone 37 to readapt the varying height of used ribbon 22 to the fixed height of ribbon pull engagement unit 83.

FIG. 9 is a top plan view of first ribbon supply portion 31 which has been enlarged to allow placement of large diameter feed reel 23 and take-up reel 24.

FIG. 10 is a top plan view of another embodiment of a first ribbon supply portion 31 wherein two large diameter feed reels 23 and take-up reel are placed in a side-by-side arrangement. In this embodiment, first ribbon supply portion 31 has been reshaped to allow angulation of the much wider shape; first ribbon supply portion 31 being pivotally coupled to second ribbon supply portion 32 at pivot coupling 38, as described hereinabove.

Figure 11B:
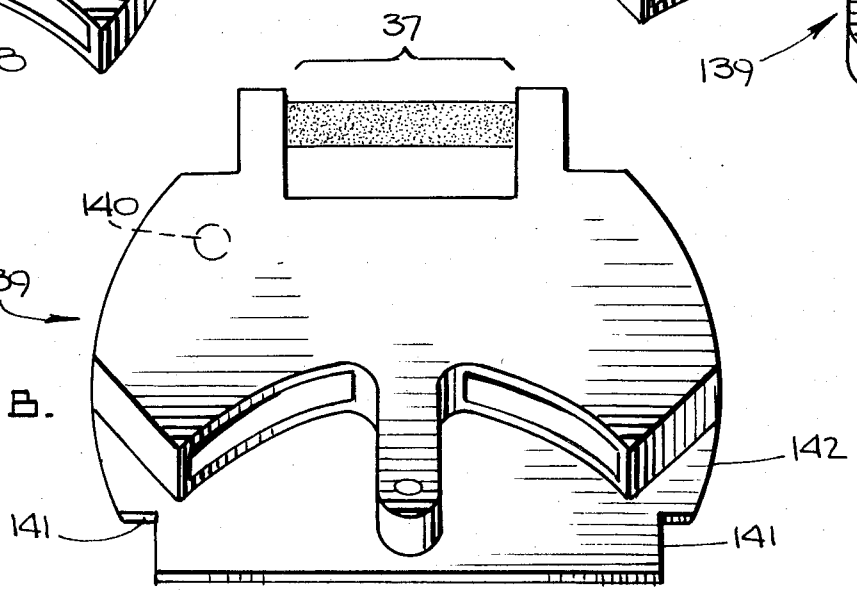
FIGS. 11A and 11B are isometric representations of respective embodiments of a ribbon supply adaptor portion.
Figure 11A:
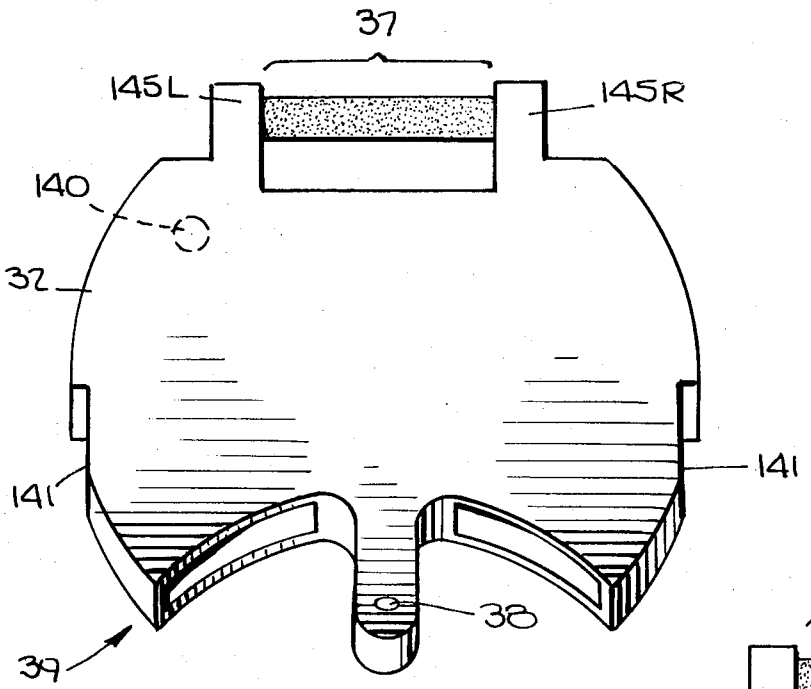

FIGS. 11A and 11B are isometric representations of various embodiments of second ribbon supply portion 32. FIG. 11A shows a configuration of a second ribbon supply portion 32 which has been shaped in the form of one well known ribbon box. An adaptor box drive input 140 has been provided so that an existing ribbon motor can drive the ribbon ensemble of both first and second ribbon supply portions. A pair of adaptor box lock-downs 141 has been included in this embodiment of the second ribbon supply portion.

Since, in known arrangements, the ribbon of the printer is usually contained within a ribbon box which corresponds only to the second ribbon supply portion, as shown in FIG. 11A, but in accordance with the invention, feed and take-up reels 23 and 24 are arranged in a first ribbon supply portion 32, an embodiment of the second ribbon supply portion may be reduced in size, as shown in FIG. 11B. In the embodiment of FIG. 11B, the position of the original lock-down point is preserved by the use of an adaptor box plate 142 with notches located at locations corresponding to adaptor box lock-downs 141. It should be evident from the foregoing that a second ribbon supply portion can be configured to have a shape which corresponds to almost any known ribbon supply box of the type which are presently known which contain the ribbon therewithin and travel on the print carriage. Although a wide variety of shapes for the second ribbon supply portions may be required to retrofit known printing arrangements to accommodate the present, dual portion ribbon supply arrangement, only relatively few shapes are required for the first ribbon supply portion. Thus, substantial economy is afforded. For a wide variety of retrofit second ribbon supply portion shapes, the only thing that may need to be changed in the first ribbon supply portion is the drive ratio for the drive hub. It should further be noted that in addition to the variety of shapes which are available for the first ribbon supply portion, the first and second ribbon supply portions, need not be either parallel or coplanar with respect to each other. In fact, the first ribbon supply portion may be arranged at an angle of up to 90 degrees with respect to the second ribbon supply portion.

Figure 12:
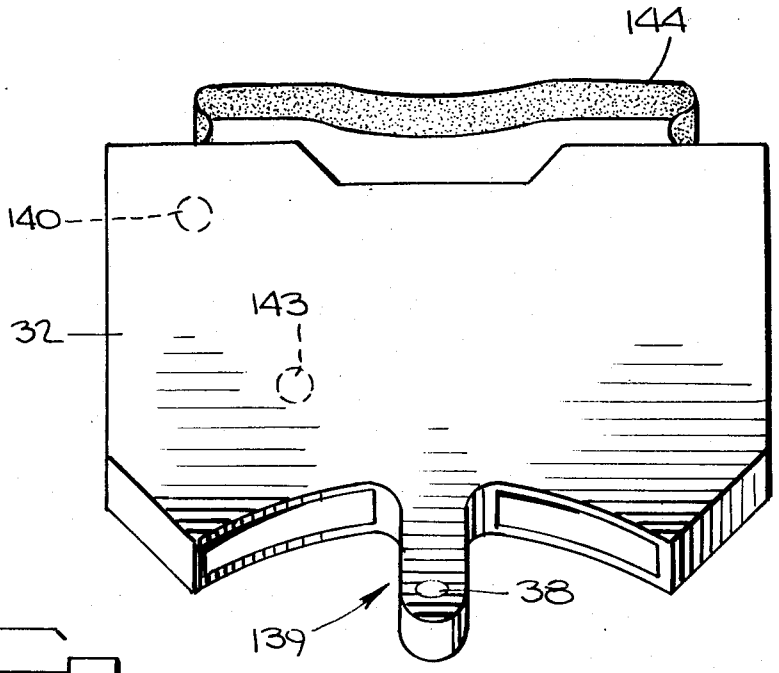
FIG. 12 is an isometric representation of a further ribbon supply adaptor portion.

FIG. 12 is an isometric representation of a ribbon box adaptor version of a second ribbon supply portion. As shown in this figure, adaptor box 139 utilizes a loop of ribbon 144 which is to be placed manually in ribbon utilization zone 37. Such manual placement is distinguishable from the drop-in type of ribbon box shown in FIG. 11. In addition, since for some ribbon boxes there are two drive input alternative positions, adaptor box 139 has adaptor box drive input 140 which is augmented by an adaptor box alternative drive input 143, in the second location. Such a variety of drive input positions is provided so that the same cartridge can fit more than one model of printer.

What is claimed is:

1. In a printer comprising a chassis, a paper support platen mounted on said chassis, a printing carriage, means mounting said printing carriage for translation with respect to said chassis and said paper support platen, a ribbon supply system comprising:

a ribbon reel support means a ribbon feed reel and a ribbon take-up reel both rotatably mounted on said ribbon reel support means in a predetermined orientation with respect to one another;

first means for pivotally mounting said ribbon reel support means to said printing carriage;

second means for pivotally mounting said ribbon reel support means to said chassis wherein at least a portion of the weight of said ribbon reel support means having rotatably mounted thereon said feed reel and said take-up reel is borne by said second means;

means for permitting reciprocating movement of said ribbon reel support means with respect to said chassis responsive to translation of said printing carriage with respect to said chassis.

2. A device as recited in claim 1 further comprising:

means for providing a print ribbon path from said ribbon feed reel to said print carriage and then from said print carriage to said ribbon take-up reel;

means for transporting a print ribbon in said print ribbon path, said print ribbon transporting means being mounted to said chassis.

3. A device as recited in claim 2 wherein said print ribbon path includes a first portion extending from said ribbon feed reel to said printing carriage and a second portion extending from said printing carriage to said ribbon take-up reel;

a print ribbon is disposed in said printing ribbon path; and said print ribbon transporting means engages said print ribbon in said second portion of said print ribbon path for transport thereof in said print ribbon path.

4. A device as recited in claim 3 wherein said means for transporting said print ribbon comprises:

a drive member mounted for rotation about a first axis of rotation, said drive member having a first predetermined number of ribbon engagement rollers arranged equidistant from said first axis of rotation, each ribbon engagement roller having an individual axis and being mounted to said drive member for rotation about said individual axis;

an idler member mounted for rotation about a second axis of rotation, said idler member having a second predetermined number of ribbon engagement rollers arranged equidistant from said second axis of rotation, each ribbon engagement roller having an individual axis of rotation and being mounted to said idler member for rotation about said individual axis;

said ribbon engagement rollers on said drive member and said idler member meshing respectively with each other as said drive member and said idler member are rotated about their respective axes of rotation, the print ribbon being interposed between said meshing ribbon engagement rollers.

5. A device as recited in claim 4 wherein there is further provided means for varying a distance between said first and second axes of rotation whereby said ribbon engagement rollers of said drive member and said idler member are unmeshed for facilitating replacement of the print ribbon therebetween.

6. A device as recited in claim 4 wherein there is further provided drive means for discontinuously rotating said drive member in predeterminable increments of rotational movement.

7. A device as recited in claim 4 wherein said ribbon engagement rollers of said drive member and said ribbon engagement rollers of said idler member are generally cylindrical in shape.

8. A ribbon drive arrangement for engaging a ribbon having a longitudinal dimension and urging the ribbon in a direction substantially along said longitudinal dimension, said ribbon drive arrangement comprising:

a drive member mounted for rotation about a first axis of rotation, said drive member having a first predetermined number of ribbon engagement rollers arranged equidistant from said first axis of rotation, each ribbon engagement roller having an individual axis spaced from said first axis and being mounted to said drive member for rotation about each of said individual axes;

an idler member mounted for rotation about a second axis of rotation, said idler member having a second predetermined number of ribbon engagement rollers arranged equidistant from said second axis of rotation, each ribbon engagement roller having an individual axis of rotation spaced from said second axis and being mounted to said idler member for rotation about each of said individual axes;

said ribbon engagement rollers on said drive member and said idler member meshing respectively with each other as said drive member and said idler member are rotated about their respective axes of rotation, the print ribbon being interposed between said meshing ribbon engagement rollers.

9. A device as recited in claim 8 wherein there is further provided means for varying a distance between said first and second axes of rotation whereby said ribbon engagement rollers of said drive member and said idler member are unmeshed for facilitating replacement of the ribbon therebetween.

10. A device as recited in claim 8 wherein there is further provided drive means for discontinuously rotating said drive member in predeterminable increments of rotational movement.

11. A device as recited in claim 8 wherein said ribbon engagement rollers of said drive member and said ribbon engagement rollers of said idler member are generally cylindrical in shape.

* * * * *